US010215186B1

(12) United States Patent
Wagner

(10) Patent No.: US 10,215,186 B1
(45) Date of Patent: Feb. 26, 2019

(54) ROTARY MACHINE PROVIDING THERMAL EXPANSION COMPENSATION, AND METHOD FOR FABRICATION THEREOF

(71) Applicant: Jerald G. Wagner, Myakka City, FL (US)

(72) Inventor: Jerald G. Wagner, Myakka City, FL (US)

(73) Assignee: ROTARY MACHINE PROVIDING THERMAL EXPANSION COMPENSTION, AND METHOD FOR FABRICATION THEREOF

( * ) Notice: Subject to any disclaimer, the term of this patent is extended or adjusted under 35 U.S.C. 154(b) by 127 days.

(21) Appl. No.: 15/255,200

(22) Filed: Sep. 2, 2016

(51) Int. Cl.

| | |
|---|---|
| ***F03C 2/00*** | (2006.01) |
| ***F03C 4/00*** | (2006.01) |
| ***F04C 15/00*** | (2006.01) |
| ***F04C 2/00*** | (2006.01) |
| ***F04D 29/059*** | (2006.01) |
| ***F04D 17/10*** | (2006.01) |
| ***F04D 29/28*** | (2006.01) |
| ***F04D 29/42*** | (2006.01) |
| ***F04D 29/053*** | (2006.01) |
| ***F01D 5/04*** | (2006.01) |
| ***F01D 25/16*** | (2006.01) |
| ***F01D 25/24*** | (2006.01) |
| ***F04C 18/16*** | (2006.01) |

(52) U.S. Cl.

CPC ..... *F04D 29/059* (2013.01); *F01D 5/04* (2013.01); *F01D 25/16* (2013.01); *F01D 25/24* (2013.01); *F04C 18/16* (2013.01); *F04D 17/10* (2013.01); *F04D 29/053* (2013.01); *F04D 29/284* (2013.01); *F04D 29/4206* (2013.01); *F04C 2240/50* (2013.01); *F04C 2240/60* (2013.01); *F05D 2240/54* (2013.01); *F05D 2240/60* (2013.01); *F05D 2300/5021* (2013.01)

(58) Field of Classification Search

CPC ..... F04D 17/10; F04D 29/053; F04D 29/059; F04D 29/284; F04D 29/4206; F04C 18/16; F04C 2240/50; F04C 2240/60; F01D 5/04; F01D 25/16; F01D 25/24; F05D 2300/5021; F05D 2240/54; F05D 2240/60

USPC ..... 418/178–179, 201.1–201.3, 206.1–206.8

See application file for complete search history.

(56) References Cited

U.S. PATENT DOCUMENTS 4,963,041 A 10/1990 Sowards
5,226,791 A * 7/1993 Miwa ..... F04C 29/0078 418/179

(Continued)

OTHER PUBLICATIONS

United States Air Force Contract AF 33(616)-7006.

*Primary Examiner* — Theresa Trieu

(57) ABSTRACT

A temperature-compensating arrangement is provided for a fluid-moving or fluid-powered rotating machine. One or more rotatable inner components in a housing of the machine are supported and restrained by at least one radial load bearing and allowed to float axially as a result of differences in thermal expansion of one or more inner components and the housing. The housing and inner component(s) are made from materials having coefficients of expansion selected to minimize undesired clearance changes and undesired bearing loads that are caused by the differences in thermal expansion of the materials during temperature changes of the machine.

14 Claims, 3 Drawing Sheets

(56) References Cited

U.S. PATENT DOCUMENTS

| | | | | |
|---|---|---|---|---|
| 5,338,168 | A * | 8/1994 | Kondoh | F04C 29/0078 418/179 |
| 6,135,641 | A | 10/2000 | Smith | |
| 6,918,749 | B2 * | 7/2005 | Garczorz | F04C 29/0078 418/179 |
| 8,340,489 | B2 | 12/2012 | Sarmaala | |
| 2006/0153698 | A1 | 7/2006 | Makino et al. | |
| 2007/0259199 | A1 * | 11/2007 | Arnhold | F04C 2/08 418/61.3 |

* cited by examiner

ROTARY MACHINE PROVIDING THERMAL EXPANSION COMPENSATION, AND METHOD FOR FABRICATION THEREOF

GOVERNMENT LICENSE RIGHTS

The U.S. Government has a paid-up license in this invention and the right in limited circumstances to require the patent owner to license others on reasonable terms as may be provided for by the terms of Contract Number: W31P4Q-13-C-0049_CFMH, Contract Title: Vapor-Liquid Pump for Mixed Phase Refrigerant, awarded by the U.S. Army Aviation and Missile Command-Redstone.

CROSS REFERENCE TO RELATED APPLICATIONS

This application is related to U.S. patent application Ser. No. 15/255,617, filed Sep. 2, 2016, entitled "Non-Contacting Bidirectional Seal For Gaseous Rotary Machines" in the name of Jerald G. Wagner et al. and to U.S. patent application Ser. No. 15/255,657 filed Sep. 2, 2016, entitled "An Improved Passage Arrangement For Cooling, Lubricating And Reducing The Size Of Rotary Machines" in the name of Jerald G. Wagner.

BACKGROUND AND SUMMARY OF THE INVENTION

The present invention relates to machinery with sliding or rotating components such as a screw type compressor or supercharger. It addresses specific combinations of materials, arrangement of components, and methods to compensate for thermal expansion. The invention improves size and weight of the assembly. Components can be assembled at room temperature while a better fit is created at operating temperature.

Using an aluminum housing in, for example, a screw compressor to decrease compressor weight is highly desirable but has proven to be problematic. If, for example, steel rotors and/or rotor shafts are used in a typical aluminum housing, the different coefficient of thermal expansion (CTE) rates between such materials can introduce undesirable rotor-to-housing clearances and/or substantial changes in bearing loads. One object of my invention is to use a combination of alloys to optimize CTE effects.

Another object of my invention is to provide an improved way of transferring torque between components so that these components can be joined or assembled at room temperature with the joint between them improving (i.e., becoming tighter) as the compressor temperature transitions to that of normal operation. I have found that this can be achieved by allowing the joint to float axially during the temperature transition period, thereby eliminating axial component loading from CTE differences from the drive mounting mechanisms.

When the appropriate materials are used in accordance with my invention, assembly of a component positioned by interference fit (such as an inner radial load bearing race on rotor and/or rotor shaft) can be accomplished by submerging the rotor/rotor shaft in liquid nitrogen. This extreme cold condition can quickly shrink the rotor/rotor shaft to create sufficient clearance for installation of the interference fit component over the shaft without significant permanent changes in material properties.

Still another object of my invention is to further reduce compressor size by including the drive joint connection feature in the drive shaft itself to allow precise positioning of rotational components while sharing a common bearing. Concentricity of coupled components is very critical in high rotational speed machines. This method decouples concentricity control and torque transfer to separate features, thus improving manufacturability. In addition to reduced size by eliminating independent support bearing(s) from one end of the drive shaft, my invention has the advantage of reducing complexity in the lubrication system by eliminating said bearing. Alignment details between drive and driven components is simplified by combining the support of two mating shaft ends with a single bearing.

BRIEF DESCRIPTION OF THE DRAWINGS

Other objects, advantages and novel features of the present invention will become apparent from the following detailed description when considered in conjunction with the accompanying drawings herein.

DETAILED DESCRIPTION OF THE DRAWINGS

Figure 1:
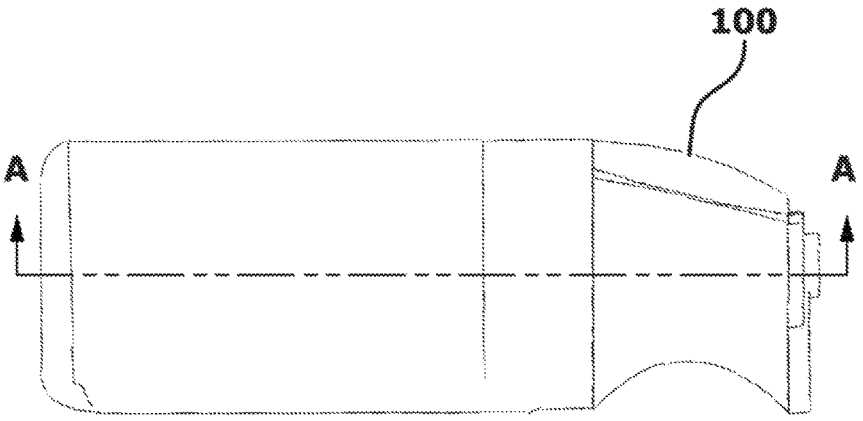
FIG. 1 is an elevational view of a screw compressor of generally known construction that uses the principles on my invention.
Figure 2:
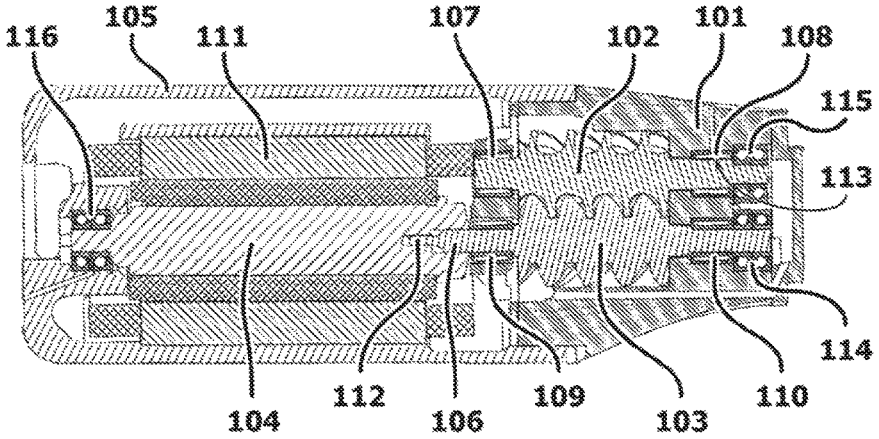
FIG. 2 is a cross-sectional plan view of the screw compressor with coupled drive motor shaft according to my invention taken along line A-A of FIG. 1.

Referring now to FIGS. 1 and 2, a housing 101 of the screw compressor generally designated by numeral 100 is made from an aluminum such as alloy 4032, A390 or other materials having the properties needed for implementing the present invention such as an alloy containing 10% or more silicon, and is provided with one or more inner components in the form of rotors and/or rotor shafts 102, 103 having CTE characteristics within 20% of that of the housing 101 such as nitrogen-strengthened austenitic stainless steel such as High-Strength to minimize differences in thermal expansion between the compressor components while, at the same time, creating a lightweight and durable assembly.

As the temperature of the screw compressor increases during operation, the housing 101 expands at a higher rate than rotor/rotor shafts 102, 103. Radial load bearings 107, 108 provided at the ends of shaft 102 and radial load bearings 109, 110 provided at the ends of shaft 103 are arranged to allow the respective shafts 102, 103 to float axially and therefore create no additional axial component loading due to thermal expansion.

Figure 3:
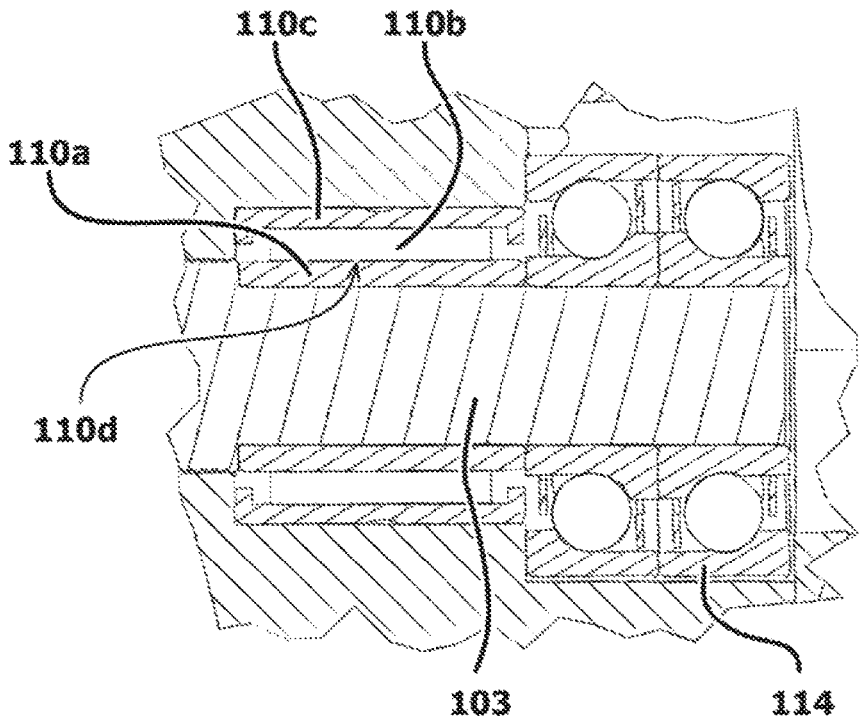
FIG. 3 is an enlarged isolated view showing details of one of the radial load bearings shown in FIG. 1, it being understood that the bearings are arranged cylindrically around a shaft in a known manner.

In particular, each bearing arrangement supporting rotor/rotor shaft radial loads is not axially constrained. This is achieved by configuring the radial bearings 107, 108, 109, 110 as cylindrical rolling elements 110*b* as seen in FIG. 3 that can ride directly on the rotor shaft 103 or on an inner bearing race 110*a*, the latter being shown in FIG. 3 by way of example in connection with the inner component that is the driven rotor shaft 103 with the understanding that each of the radial bearings 107, 108, 109, 110 is similarly configured. Bearing rolling elements 110*b* are constrained axially within an outer bearing race 110*c*. Each rotor/rotor shaft, in the illustrated example shaft 103, is axially free-floating where rolling elements 110*b* directly contact shaft 102 at surface 113 (FIG. 2) or shaft 103 at inner bearing race surface 110*d* to compensate for thermal expansion differences between housing 101 and the inner components comprised of the rotor/rotor shafts 102, 103. Conventional bearings 114, 115 provide for precise axial location of the respective rotor/rotor shaft 102, 103 in the housing 101.

Input shaft 104 constituting a drive component has a conventional ball bearing 116 on one end to control that shaft's axial location in the housing 105 plus axial and radial loads. Bearing 116 moves with housing 105 during thermal expansion. Since housing 105 containing the driving structure 112 has a different thermal expansion rate than that of associated housing 101, rotor/rotor shaft 103, and rotor/rotor shaft 104, a concentric support joint 106 and the drive structure 112 are required to allow axial motion without creating additional axial loads.

Shaft 104 is arranged to transfer rotational power through drive structure 112 and fits or nestles one shaft inside the other at joint 106, thereby advantageously creating support for one end of shaft 104 through shaft 103 and bearing 109, and further allowing axial movement to accommodate thermal expansion differences in housing 101, housing 105, rotor/shaft 103 (constrained by bearing 114), and motor/shaft 104 (constrained by bearing 116) at drive structure 112 and shaft-to-shaft support joint 106. This arrangement has the benefit of maintaining concentricity between shafts 103, 104 at joint 106 and transferring torque through the drive structure 112, concentricity of coupled components being very crucial in high rotational speed machines to minimize dynamic rotational imbalance such as might be caused by non-symmetric rotating masses such as a nested shaft. Bearing 109 supports and accurately controls the rotational location of the rotor/shaft 103 which supports shaft 104 in a nested arrangement wherein the clearance existing between the shafts at the joint 106 would otherwise allow the shaft to be non-concentric to the rotor/shaft 103 and bias the mass off the axis of the rotor/shaft 103 to create an undesired imbalance in the shaft 104.

My invention decouples concentricity control and torque transfer to separate features, thus also improving manufacturability. The concentric control is simplified to a round shaft 106 in a round bore, where common manufacturing techniques can hold very tight tolerances (0.0002 inch). Materials as are chosen for shafts 103, 104 so that they have sufficient clearance for assembly at room temperature and the clearance at joint 106 decreases as the shafts transition to temperatures of design or normal operation. This shaft arrangement relieves axial bearing loads generated by thermal expansion of full assembly, improves shaft-to-shaft concentricity between shafts 103, 104 for high speed operation, uses a shared bearing 109 to reduce the number of bearings and complexity of associated lubrication schemes for said bearings, condenses overall package size, and reduces the weight of the full assembly.

Figure 4:
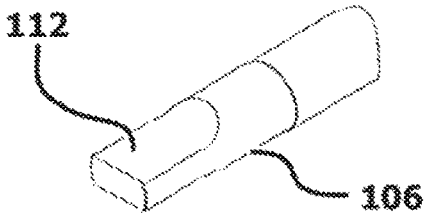
FIG. 4 is a first contemplated embodiment of a concentric drive using two flat areas on the end of a shaft as a torque transfer mechanism in accordance with my invention.
Figure 5:
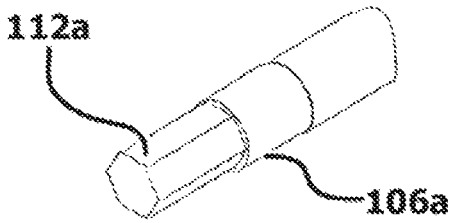
FIG. 5 is second contemplated embodiment of a concentric drive using a series of flat areas on the end of a shaft as a torque transfer mechanism.
Figure 6:
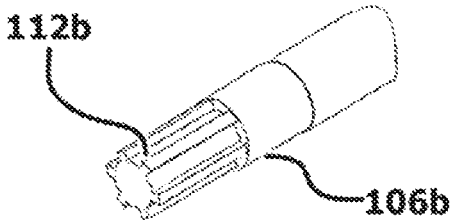
FIG. 6 is a third contemplated embodiment of a concentric drive using a straight spline on the end of a shaft as a torque transfer mechanism.
Figure 7:
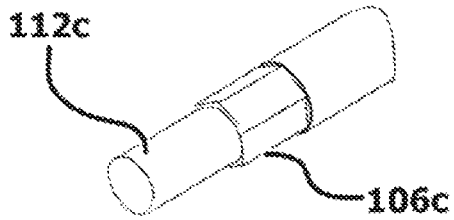
FIG. 7 is a fourth contemplated embodiment of a concentric drive using a series of flat areas on the end of a shaft as a torque transfer mechanism.

Torque transfer is achieved by a form-locking feature 112 (FIG. 4), 112*a* (FIG. 5), 112*b* (FIG. 6) and 112*c* (FIG. 7) that is symmetrical about the rotational axis and avoids the need for keyways or keys that might move during operation or become problematic to dynamically balance and assemble so as to achieve a balance quality grade of G2.5.

The present invention is not limited to screw compressors, but may be used with any device, such as a supercharger, radial turbine and centrifugal compressor, that operates throughout a temperature range, is constructed of dissimilar materials and has rotational components. Therefore, I do not intend to be limited to the details shown and described in this application but rather seek to protect all such changes and modifications that are encompassed by the scope of my claims.

I claim:

1. A temperature-compensating arrangement for a machine that utilizes a compressible fluid, comprising:

an aluminum alloy housing; and at least one inner component located within the housing and configured to be rotatable, the at least one inner component being comprised of an austenitic stainless steel alloy;

wherein the alloys selected for the housing and the at least one inner component have coefficients of thermal expansion that minimize undesired clearance and bearing load conditions during operation of the machine.

2. The arrangement of claim 1, wherein the alloy of the at least one inner component is configured to have a coefficient of thermal expansion of 80% to 125% as that of the alloy of the housing.

3. The arrangement of claim 1, wherein the aluminum alloy containing at least 10% silicon by weight is employed for the aluminum alloy housing.

4. The arrangement of claim 1, wherein the housing is comprised of 4000-series aluminum alloy, and the austenitic stainless steel alloy is a nitrogen-strengthened-type alloy.

5. The arrangement of claim 1, wherein the housing is comprised of 390-series aluminum alloy, and the austenitic stainless steel alloy is a nitrogen-strengthened-type alloy.

6. The arrangement of claim 1, wherein the at least one inner component comprises a first component configured to be captured by a second component outside the housing to form a drive connection.

7. The arrangement of claim 1, wherein the housing is of one of a screw compressor housing, a supercharger housing, a centrifugal compressor housing, and a radial turbine housing.

8. A temperature-compensating arrangement for a sliding machine or rotating machine, comprising:

first and second housings having different thermal expansion rates during operation of the machine;

a first component configured to be rotatable within the first of the housings; and a second component configured to be rotatable in the second of the housings and to be captured with respect to the first component to provide a floating drive connection, wherein the floating drive connection comprises a rotationally form-locking yet axially free association between the first and second components.

9. The arrangement of claim 8, wherein the floating drive connection is configured such that the first component is configured to move axially in the machine during thermal expansion of the first and second components at contact surfaces on associated radially loaded bearings.

10. The arrangement of claim 8, wherein the second component is a machine drive shaft.

11. The arrangement of claim 8, wherein the first of the housings is of one of a screw compressor housing, a supercharger housing, a centrifugal compressor housing, and a radial turbine housing.

12. A temperature-compensating arrangement for a rotating machine that employs a compressible fluid, comprising:

a housing comprised of an aluminum alloy; and at least one rotatable inner component within the housing and comprised of a nitrogen-strengthened alloy; wherein the at least one inner component is configured to be supported and restrained by at least one radial load bearing and allowed to float axially due to differences in thermal expansion of the at least one inner component and the housing.

13. The arrangement of claim 12, wherein the at least one inner component comprises a first component configured to be captured by a drive component to form a floating connection.

14. The arrangement of claim 12, wherein the housing is of one of a screw compressor housing, a supercharger housing, a centrifugal compressor housing, and a radial turbine housing.

* * * * *